US005179940A

United States Patent [19]

Barreiro

[11] Patent Number: 5,179,940

[45] Date of Patent: Jan. 19, 1993

[54] METHOD FOR MASSAGING THE SPINAL AREA AND ADJACENT BACK MUSCLES IN AN IMPROVED KNEADING MOTION

[75] Inventor: Armando Barreiro, Miami, Fla.

[73] Assignee: Swerve Systems, Inc., Albuquerque, N. Mex.

[21] Appl. No.: 676,541

[22] Filed: Mar. 28, 1991

[51] Int. Cl.[5] ..... A61H 1/00

[52] U.S. Cl. ..... 128/33; 128/52; 128/57

[58] Field of Search ..... 128/52, 55, 56, 57, 128/58, 60, 33, 35, 24.3, 44, 45, 46

[56] References Cited

U.S. PATENT DOCUMENTS

| | | | |
|---|---|---|---|
| 3,800,785 | 4/1974 | Inada | 128/55 |
| 4,079,732 | 3/1978 | Shinichiro | 128/55 |
| 4,615,336 | 10/1986 | Fujimoto | 128/52 |
| 4,718,408 | 1/1986 | Barreiro | 128/57 |
| 4,875,470 | 10/1989 | Cotone | 128/57 |

*Primary Examiner*—Robert A. Hafer
*Assistant Examiner*—David J. Kenealy
*Attorney, Agent, or Firm*—Frank L. Kubler

[57] ABSTRACT

A method for applying a mechanical massage while the back of a user is against the back rest of a chair or lying on a bed uses a massage mechanism unit having a pair of spaced parallel arm members and a massaging wheel rotatably supported on one end of each of the arm members. The massaging wheels are positioned on the back of the user on opposite sides of the spinal column. The massaging wheels are then simultaneously moved and turned in the same direction from left to right and right to left while moving back and forth along sinusoidal paths on two sides of the spinal column. The pressure exerted by one of the massaging wheels on the back is reduced by moving the massaging wheel away from the back as the massaging wheel moves closer to the spinal column. The pressure exerted by the other massaging wheel is increased by moving the massaging wheel toward the back as the massaging wheel moves away from the spinal column. The massaging wheels thus alternatingly move toward and away from the spinal column. The massaging wheels apply the same amount of pressure on the user's back and are at the same height relative to the spinal column when equally spaced from the spinal column.

1 Claim, 9 Drawing Sheets

METHOD FOR MASSAGING THE SPINAL AREA AND ADJACENT BACK MUSCLES IN AN IMPROVED KNEADING MOTION

BACKGROUND OF THE INVENTION

1. Field of the Invention

The invention relates generally to a massage method, and more particularly, to a massage which can be performed by an apparatus which is installed in the back rest of a chair or in a bed and is adapted to massage desired body parts around the human spinal column and the adjacent back muscles in an improved kneading motion.

2. Description of the Related Art

There are, at present, many types of massaging mechanisms which are designed to be installed in the back rest of a chair or in a mattress. Most of these massage mechanisms provide a form of massage known as kneading, as covered by class 128 subclass 60. FIG. 1 is an illustration of a kneading massage performed by conventional massage mechanisms. Massaging wheels (A) are positioned on opposite sides of the spinal column (B1). The massaging wheels (A) then travel up and down along the user's back (B) while simultaneously moving in an inward or outward direction. Prior patents which disclose a kneading inward and outward movement include U.S. Pat. Nos. 3,633,571, 4,167,182, 4,016,872, 4,422,448, 4,009,710, 3,800,785, 4,079,732, 4,363,858, and 2,052,656.

A main disadvantage resulting from use of the above mentioned massage mechanisms is that when both massaging wheels (A) come together at the spinal column (B1), it creates a contracted point and may cause pain to the user.

A kneading massage apparatus is also disclosed in U.S. Pat. No. 4,718,408 by the applicant.

SUMMARY OF THE INVENTION

Therefore, the main objective of the present invention is to provide a massage method for massaging the spinal area and adjacent back muscles in an improved kneading massage which avoids contraction at the spinal column.

Accordingly, the preferred embodiment of a massage apparatus for performing said massage method of the present invention is adapted to be to be installed in the back rest of a chair or in a bed, and comprises: a support; a reversible motor means mounted on the support; a longitudinally extending guiding means mounted perpendicularly on the support; a massage mechanism unit movably mounted on the guiding means and including a movable first shaft extending in a direction transverse to the guiding means and a stationary second shaft similarly extending in a direction transverse to the guiding means and spaced apart from the movable first shaft, the movable first shaft having a pair of slanting and eccentric rod portions extending from either end of the movable first shaft in outward and opposite directions, each of the eccentric rod portions forming an angle with the axis of the movable first shaft, the angular positions of the eccentric rod portions relative to the movable first shaft being substantially 180 degrees out of phase, the stationary second shaft having a pair of concentric end portions, the massage mechanism unit further including a pair of spaced and parallel arm members each having one end pivoted on one of the eccentric rod portions, a pair of massaging wheels each being rotatably supported on the free end of one of the arm members, and a pair of link members each having one end pivoted on a central portion of one of the arm members and the other end connected to one of the concentric end portions of the stationary second shaft; means, associated with the reversible motor means, for axially rotating the movable shaft; and means, associated with the reversible motor means, for moving the massage mechanism unit back and forth along the guiding means.

The massaging wheels are positioned against the user's back on opposite sides of the spinal column. The massaging wheels are then simultaneously moved and turned in the same direction from left to right and right to left while moving back and forth along sinusoidal paths on both sides of the spinal column. The pressure exerted by each massage wheel on the spinal column is reduced as that massage wheel approaches the spinal column. The pressure exerted by the other massaging wheel on the back is correspondingly increased by moving the massaging wheel toward the back, as the massaging wheel moves away from the spinal column. One of the massaging wheels moves toward the spinal column while the other massaging wheel moves away from the spinal column. The massaging wheel closer to the spinal column exerts a reduced pressure on the user's back and is in a higher position relative to the spinal column. The massaging wheel farther from the spinal column exerts increased pressure on the user's back and is in a lower position relative to the spinal column. The massaging wheels apply the same amount of pressure to the user's back and are at the same height relative to the spinal column when the massaging wheels are equally spaced from the spinal column.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
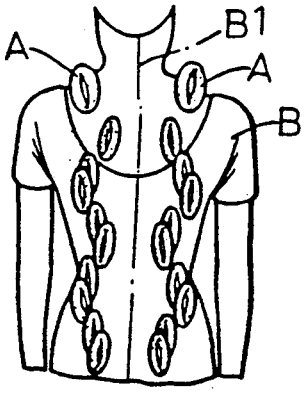
FIG. 1 (PRIOR ART)
FIG. 1 is an illustration of a conventional kneading massage method.
Figure 2:
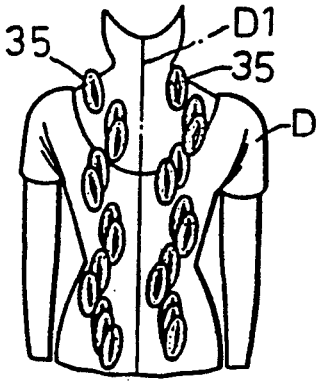
FIG. 2 (PRIOR ART)
FIG. 2 is an illustration of the preferred embodiment of an improved kneading massage method according to the present invention.

The massage method according to the present invention is illustrated in FIG. 2. A pair of massaging wheels 35 travel sinusoidal paths on both sides of the spinal column (D1). It will be shown in the succeeding paragraphs that the massaging wheel 35 closer to the spinal column (D1) applies less pressure to the user's back (D) than the massaging wheel 35 farther from the spinal column (D1).

Figure 3:
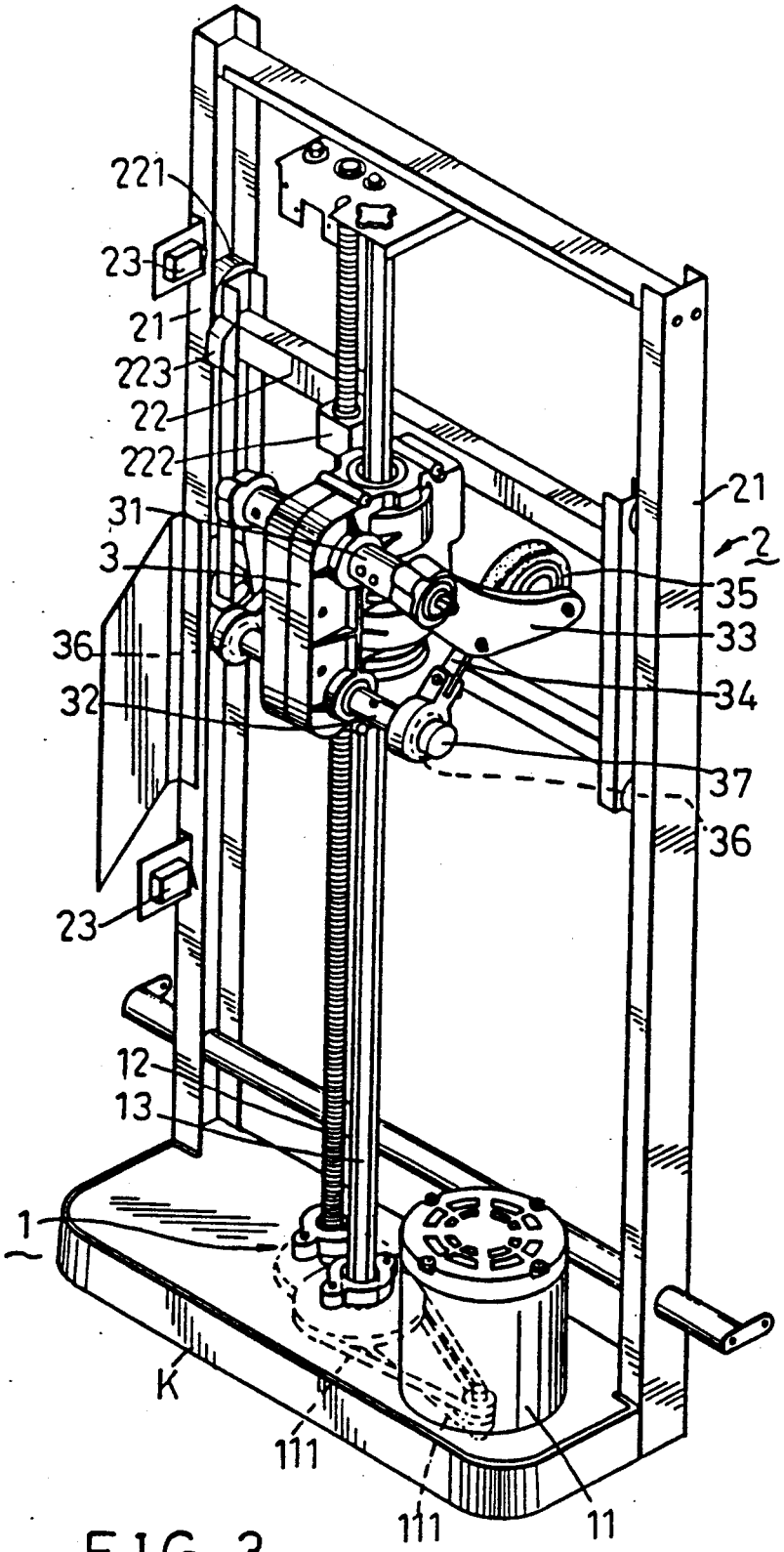
FIG. 3 is a perspective view of the preferred embodiment of a massage apparatus according to the present invention.

Referring to FIG. 3, the preferred embodiment of a massage apparatus for performing the massage method of the present invention, which is to be incorporated in the back rest of a chair or in a bed, is shown to comprise a driving mechanism 1, a sliding motion assembly 2, and a massaging mechanism 3.

The driving mechanism 1 includes a support (K), a reversible motor means 11 mounted on the support (K), a threaded sliding motion shaft 12 having one end journaled on the support (K), and a rotational drive shaft 13 similarly having one end journaled on the support (K). The rotational drive shaft 13 is hexagonal in cross section. Endless belts 111 are provided to transmit the rotational motion of the motor means 11 to the sliding motion shaft 12 and to the rotational drive shaft 13.

The sliding motion assembly 2 includes a pair of longitudinally extending elongated guide rails 21 mounted perpendicularly on the support (K) and a slide seat 22, formed as a rectangular loop. The slide seat 22 has four slide wheels 221 in sliding contact with the guide rails 21, and a screw seat 222 threadedly engaging the sliding motion shaft 12. The slide seat 22 thus moves along the guide rails 21 towards or away from the support (K) depending upon the rotation of the sliding motion shaft 12. A contact switch 23 is disposed near each distal end of one of the guide rails 21. Movement of the slide seat 22 along the guide rails 21 causes a switch actuator 223, provided on the slide seat 22, to actuate one of the contact switches 23. Once actuated, the contact switches 23 control the motor means causing it to rotate in the opposite direction, and correspondingly moving the slide seat 22 in the opposite direction. The method of reversing the rotation of the motor means 11 with the use of switches is well known in the art and as such, will not be detailed further.

The massaging mechanism 3 is fixed to the central portion of the slide seat 22 and is operably associated with the rotational drive shaft 13. Rotation of the rotational drive shaft 13 causes rotation of a movable shaft 31 disposed adjacent to one end of the massaging mechanism 3 and extending in a direction transverse to the guide rails 21. A stationary shaft 32 is disposed adjacent to the other end of the massaging mechanism 3 and is parallel to the movable shaft 31. The massaging mechanism 3 further includes a pair of arm members 33, a pair of link members 34, and a pair of massaging wheels 35. One end of each arm member 33 is pivoted on one end of the movable shaft 31. The other end of each arm member 33 rotatably supports one of the massaging wheels 35. One end of each link member 34 is pivoted on the central portion of the corresponding arm member 33. The other end of each link member 34 is connected to one end of the stationary shaft 32 via a ball joint 36. A protective cover 37, which contains lubricating oil, is provided on each ball joint 36.

Figure 4:
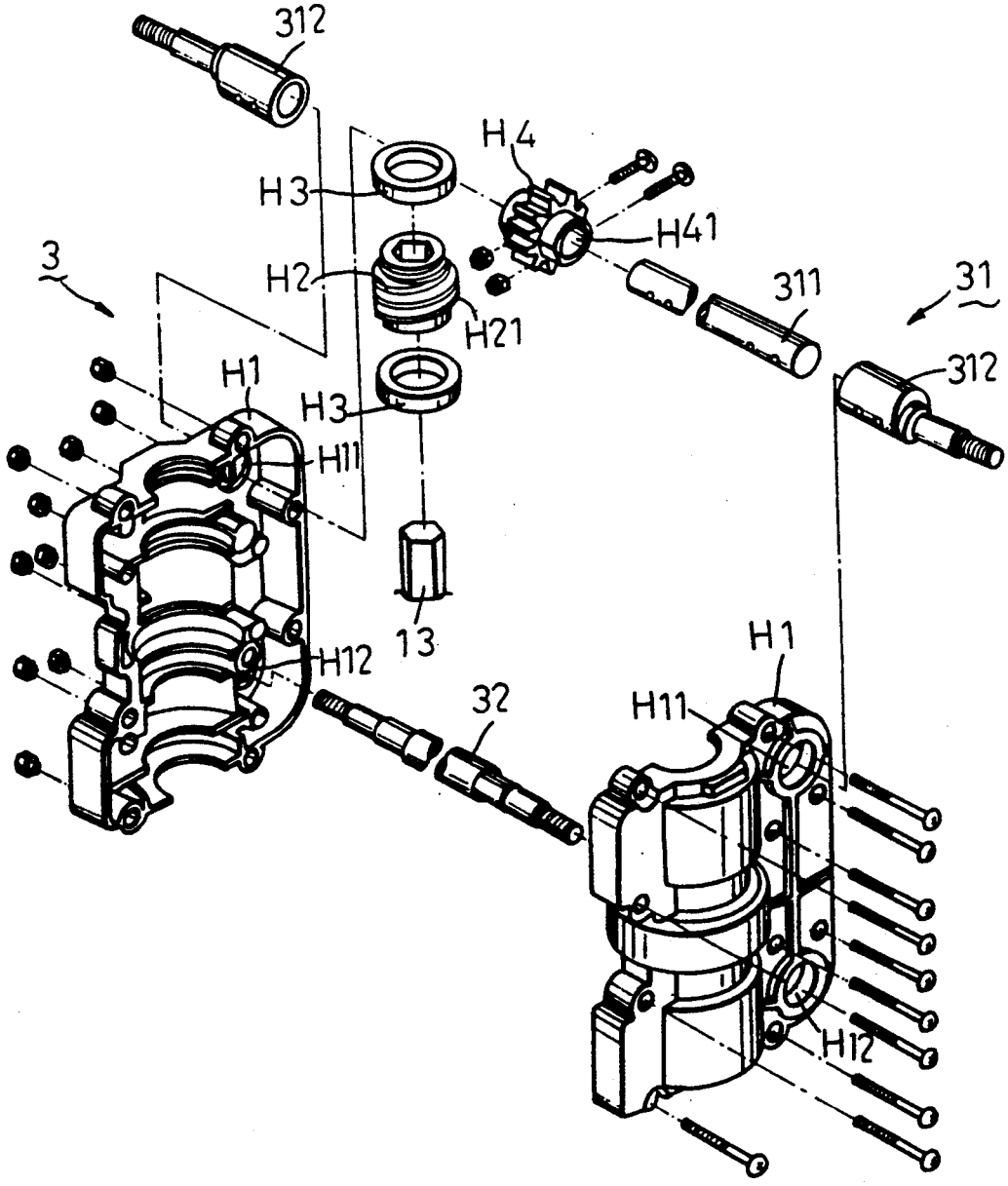
FIG. 4 is an exploded view of a massaging mechanism of the massage apparatus of the present invention.
Figure 5:
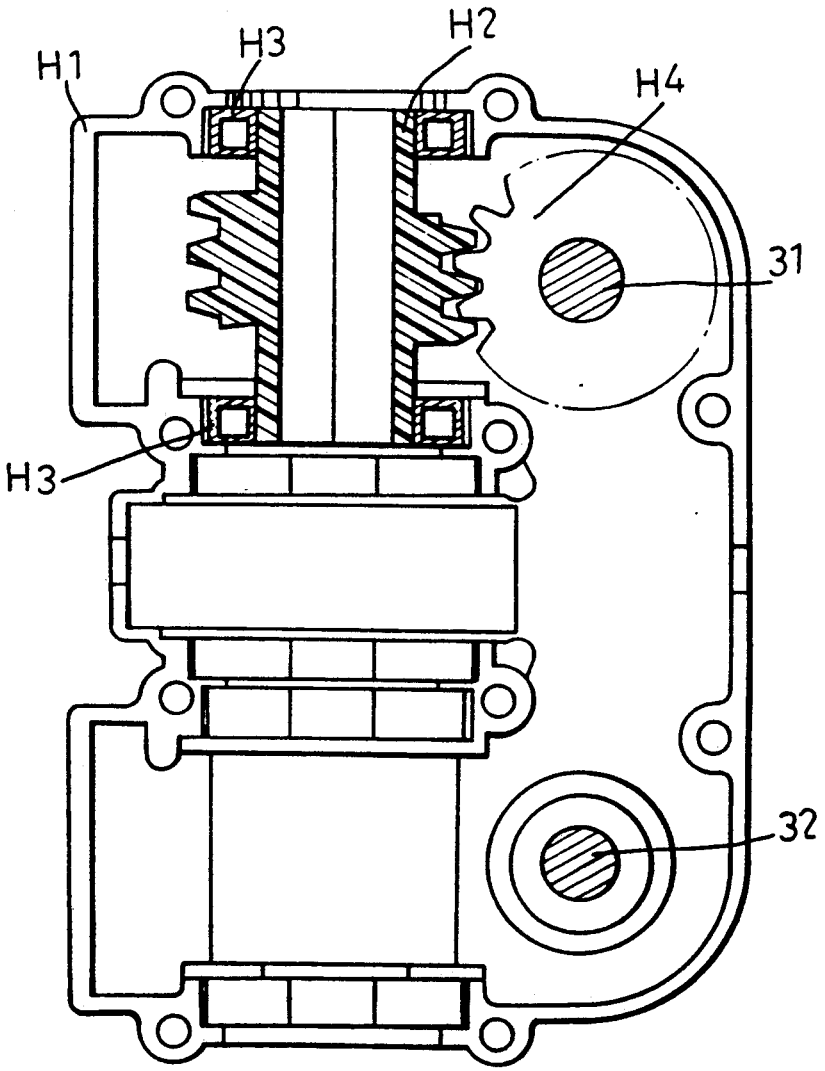
FIG. 5 is a sectional view of an assembled massaging mechanism of the preferred embodiment.

The internal components of the massaging mechanism 3 are shown in FIGS. 4 and 5. The massaging mechanism 3 further comprises a pair of matched casing halves (H1), a cylindrical sleeve (H2) disposed inside the casing halves (H1) and defining an axial opening to fittingly receive a portion of the rotational drive shaft 13, and a pair of rings (H3) respectively sleeved on either end of the cylindrical sleeve (H2). A gear (H4) engages a spiral screw thread (H21) provided on the outer surface of the cylindrical sleeve (H2). Rotation of the rotational drive shaft 13 thus correspondingly rotates the gear (H4). The gear (H4) has an axial opening (H41) to receive an axial rod portion 311 of the movable shaft 31. The two ends of the axial rod portion 311 extend out of the casing halves (H1) via the respective through holes (H11). The two ends of the axial rod portion 311 are then connected to a pair of slanting and eccentric rod portions 312. Rotation of the gear (H4) similarly rotates the movable shaft 31. The two ends of the stationary shaft 32 extend out of the casing halves (H1) via the respective through holes (H12).

Figure 6:
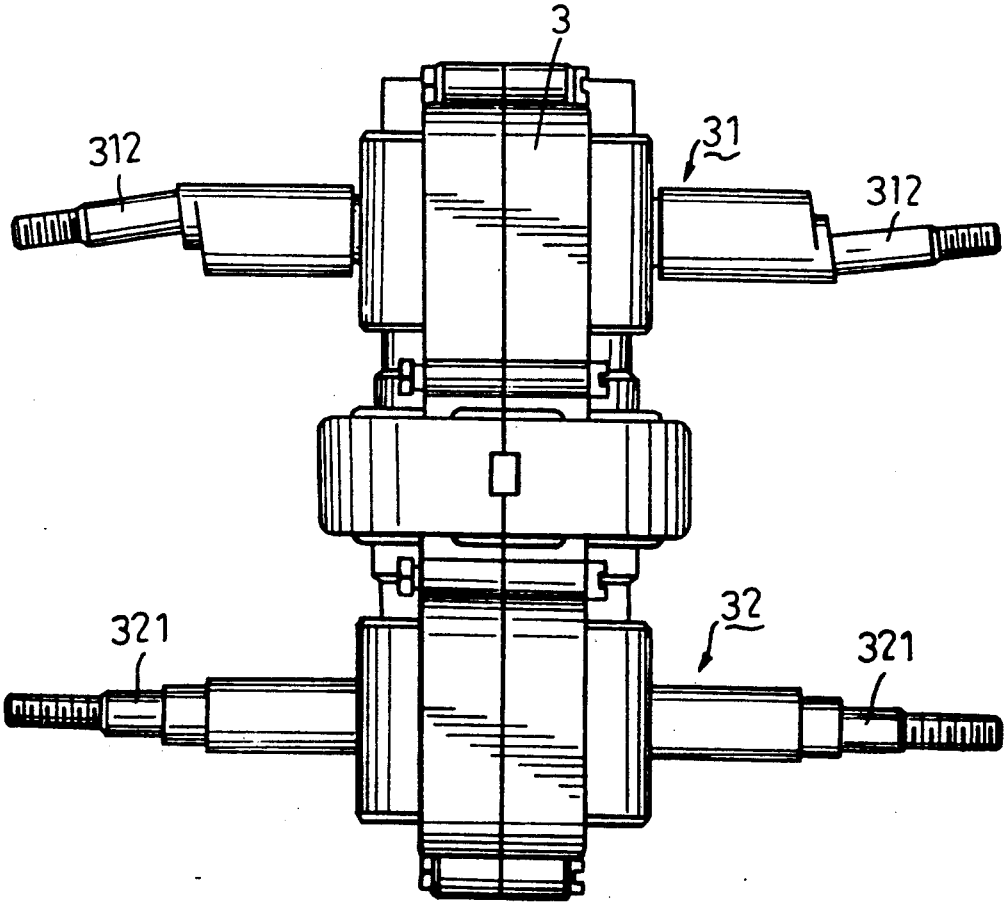
FIG. 6 is a front view of the assembled massaging mechanism shown in FIG. 5.

FIG. 6 is a front view of the assembled massage mechanism 3. The end portions 321 of the stationary shaft 32 are shown to be concentric. The eccentric rod portions 312 each form an angle with the axis of the movable shaft 31. The angular positions of the eccentric rod portions 312 relative to the movable shaft 31 are substantially 180 degrees out of phase. Rotation of the movable shaft 31 thus cause the massaging wheels 35 to move in the manner shown in FIG. 2, as will be detailed in the succeeding paragraphs.

A simplified generalization of the massaging mechanism 3 is that the massaging wheels 35 can be likened to a pair of human fists, while the arm members 33 can be likened to a pair of human arms. The link members 34 aid in moving the arm members 33. To fully understand the operation of the preferred embodiment, consider the following description of the massaging mechanism 3 under four different operating conditions.

Figure 8:
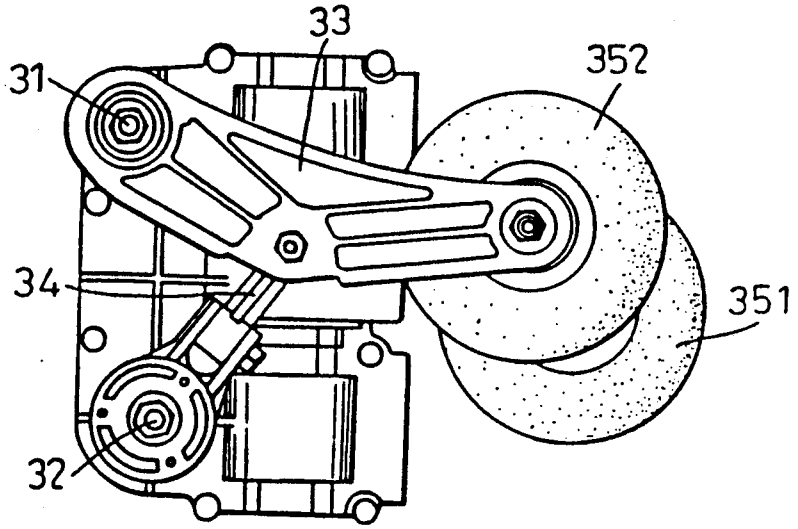
FIG. 8 is an elevational side view of the massaging mechanism shown in FIG. 7.
Figure 7:
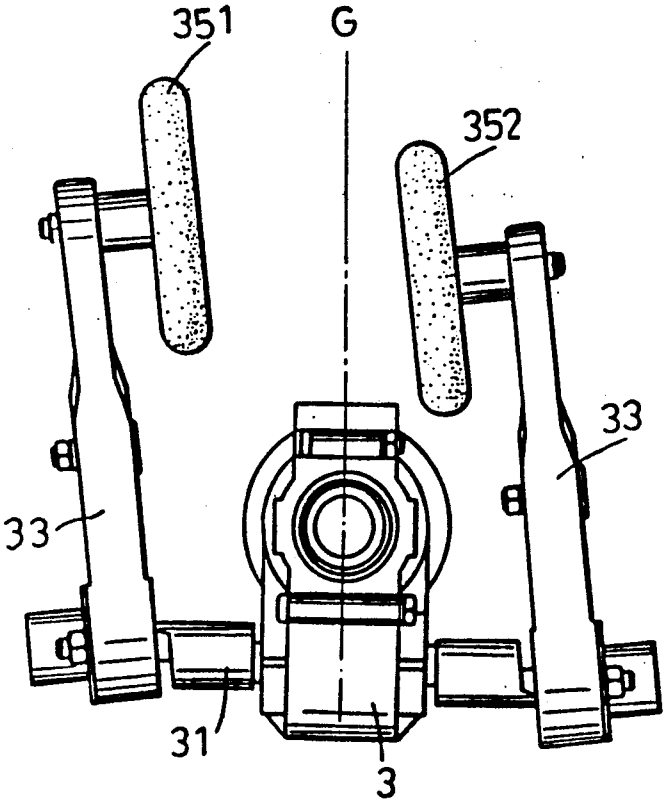
FIG. 7 is a top view of the massaging mechanism when in a first operating condition.

First Condition: Referring to FIGS. 2 and 7, the two massaging wheels 35 are positioned such that the left massaging wheel 351 extends outward and toward the user's back (D), and away from a vertical plane (G) passing through the center of the massaging mechanism 3. The right massaging wheel 352 is retracted inwardly, away from the user's back (D), and toward the vertical plane (G). When properly using the preferred embodiment, the vertical plane (G) should be aligned with the spinal column (D1). Note that the massaging wheels 351 and 352 and the respective arm members 33 are inclined relative to the vertical plane (G). This is a result of mounting the arm members 33 on the eccentric rod portions 312 of the movable shaft 31. The axes of the arm members 33 are, however, substantially parallel to one another. The pressure exerted by the left massaging wheel 351 on the user's back (D) is greater than that exerted by the right massaging wheel 352. This is because the left massaging wheel 351 is urged by the corresponding arm member 33 toward the user's back (D). Referring to FIG. 8, which is an elevational side view of the massaging mechanism 3 shown in FIG. 7, the left massaging wheel 351 is disposed at a lower level compared to the right massaging wheel 352.

Figure 10:
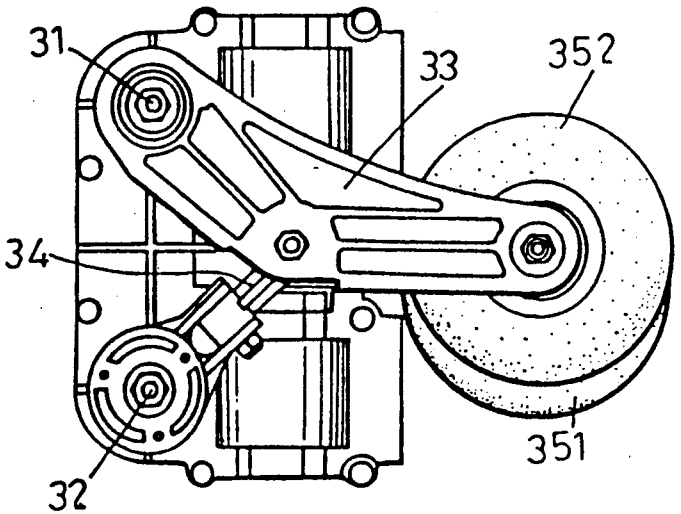
FIG. 10 is an elevational side view of the massaging mechanism shown in FIG. 9.
Figure 9:
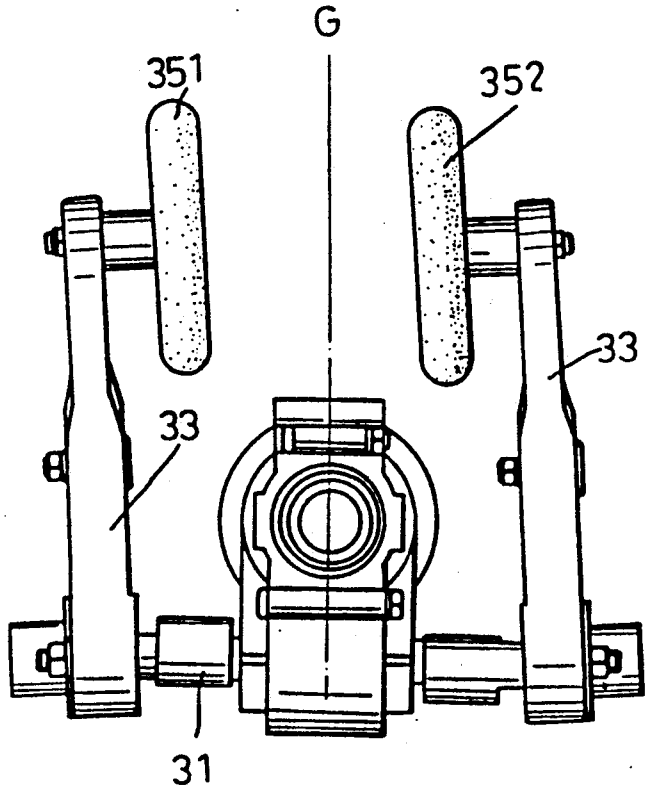
FIG. 9 is a top view of the massaging mechanism when in a second operating condition.

Second Condition: Further rotation of the movable shaft 31 moves the arm members 33 and the massaging wheels 35 from the position shown in FIG. 7 to the position shown in FIG. 9. The arm members 33 are shifted slightly to the right such that the left massaging wheel 351 is moved closer to the vertical plane (G), while the right massaging wheel 352 is moved away from the vertical plane (G). In this condition, the difference in the pressures exerted by the left and right massaging wheels, 351 and 352, on the user's back (D) is substantially reduced since the difference in the displacements of both massaging wheels, 351 and 352, from the user's back (D) is similarly reduced. Note that the axes of the arm members 33 are maintained in the substantially parallel relationship. Referring to FIG. 10, which is an elevational side view of the massaging mechanism 3 shown in FIG. 9, the difference in the heights of the left and right massaging wheels, 351 and 352, is relatively small.

Figure 12:
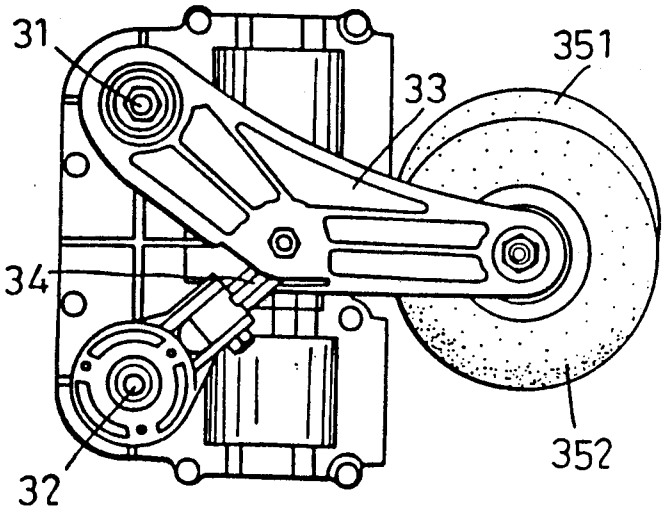
FIG. 12 is an elevational side view of the massaging mechanism shown in FIG. 11.
Figure 11:
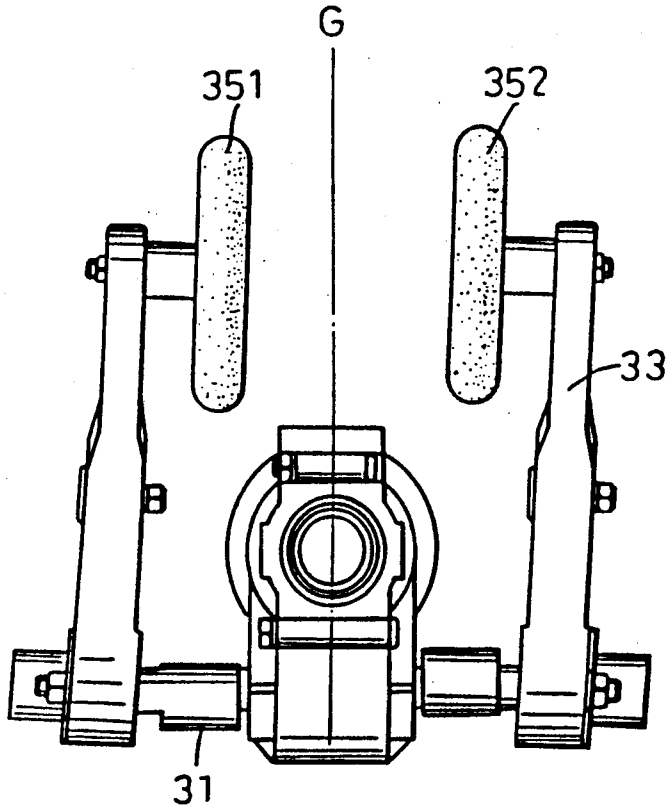
FIG. 11 is a top view of the massaging mechanism when in a third operating condition.

Third Condition: Further rotation of the movable shaft 31 moves the arm members 33 and the massaging wheels 35 from the position shown in FIG. 9 to the position shown in FIG. 11. The arm members 33 are shifted further to the right such that the left massaging wheel 351 extends slightly inward and toward the vertical plane (G), while the right massaging wheel 352 extends slightly outward and away from the vertical plane (G). The difference in the pressures exerted by the left and right massaging wheels, 351 and 352, on the user's back (D) is still relatively small since the difference in the displacements of both massaging wheels, 351 and 352, from the user's back (D) remains small. Referring to FIG. 12, which is an elevational side view of the massaging mechanism 3 shown in FIG. 11, the difference in the heights of the left and right massaging wheels, 351 and 352, is also relatively small. The left massaging wheel 351 is, however, positioned at a higher level compared to the right massaging wheel 352. It is thus shown that the positions of the massaging wheels, 351 and 352, are directly opposite to those shown in FIGS. 9 and 10.

Figure 14:
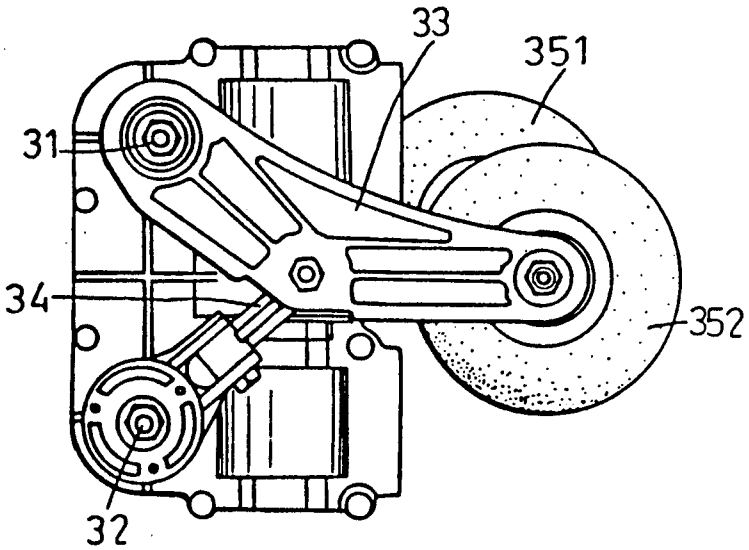
FIG. 14 is an elevational side view of the massaging mechanism shown in FIG. 13.

Fourth Condition: Further rotation of the movable shaft 31 moves the arm members 33 and the massaging wheels 35 from the position shown in FIG. 11 to the position shown in FIG. 13. The two massaging wheels 35 are positioned such that the right massaging wheel 352 extends outward and away from the vertical plane (G), while the left massaging wheel 351 is retracted inward and toward the vertical plane (G). The pressure exerted by the right massaging wheel 352 on the user's back (D) is greater than that exerted by the left massaging wheel 351, since the right massaging wheel 352 is urged by the respective arm member 33 towards the user's back (D), while the left massaging wheel 351 is urged away from the user's back (D). Referring to FIG. 14, which is an elevational side view of the massaging mechanism 3 shown in FIG. 13, the right massaging wheel 352 is disposed at a lower level compared to the left massaging wheel 351. It is thus shown that the positions of the massaging wheels, 351 and 352, are directly opposite to those shown in FIGS. 7 and 8.

Figure 13:
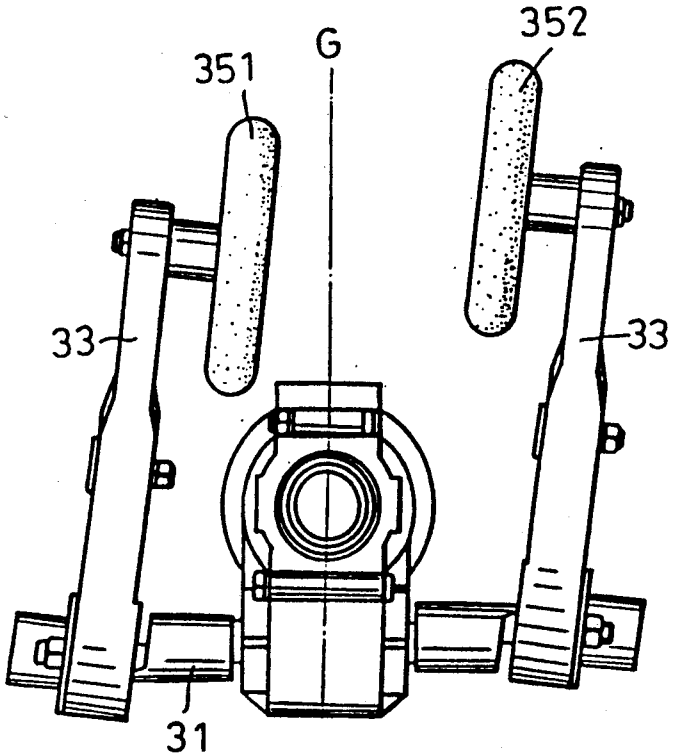
FIG. 13 is a top view of the massaging mechanism when in a fourth operating condition.

After reaching the position shown in FIGS. 13 and 14, further rotation of the movable shaft 31 shifts the arm members 33 and the massaging wheels 35 in the opposite direction to return the arm members 33 and the massaging wheels 35 to the position shown in FIGS. 7 and 8. The motor means 11 rotates the movable shaft 31, moving the massaging mechanism 3 up and down the guide rails 21. It is thus shown that the massaging wheels 35 are moved simultaneously from left to right and right to left of the vertical plane (G) and are thus alternatingly moved toward and away from the vertical plane (G). The massaging wheels 35 are also moved back and forth along the vertical plane (G). The massaging wheel 35 closer to the vertical plane (G) is urged away from the user's back (D) and is in a higher position relative to the spinal column (D1) and therefore applies less pressure to the user's back (D). The massaging wheel 35 farther from the vertical plane (G) is urged toward the user's back (D) and is in a lower position relative to the spinal column (D1) and therefore applies more pressure. The massaging wheels 35 apply the same amount of pressure and are at the same height relative to the spinal column (D1) when the massaging wheels 35 are equally spaced from the vertical plane (G). The massaging wheels 35 thus cooperatively generate the improved kneading massage output as shown in FIG. 2.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A method for applying a mechanical massage while the back of a user is against the back rest of a chair or lying on a bed, said method using a massage mechanism unit having a pair of spaced apart wheel support means and a massaging wheel rotatably supported on one end of each of said wheel support means, said method comprising the steps of:

(a) positioning said massaging wheels against the back of the user on opposite sides of the spinal column;

(b) simultaneously moving and turning said massaging wheels in the same direction from left to right and right to left while moving said massaging wheels back and forth along sinusoidal paths on two sides of the spinal column;

(c) reducing the pressure exerted by one of said massaging wheels on the back by moving said one massaging wheel away from the back as said one massaging wheel moves closer to the spinal column; and (d) increasing the pressure exerted by the other one of said massaging wheels on the back by moving said other massaging wheel toward the back as said other massaging wheel moves away from the spinal column;

whereby, one of said massaging wheels moves toward the spinal column while the other said massaging wheel moves away from the spinal column, said massaging wheel closer to the spinal column exerting a reduced pressure on the back of the user, said massaging wheel farther from the spinal column exerting an increased pressure on the back of the user, said massaging wheels applying the same amount of pressure to the back of the user and being at the same height relative to the spinal column when said massaging wheels are equally spaced from the spinal column.

* * * * *

UNITED STATES PATENT AND TRADEMARK OFFICE

CERTIFICATE OF CORRECTION

PATENT NO. : 5,179,940

DATED : January 19, 1993

INVENTOR(S) : Armando Barreiro

It is certified that error appears in the above-identified patent and that said Letters Patent is hereby corrected as shown below:

In FIG. 2 of the drawings, delete the words "(PRIOR ART)".

Signed and Sealed this

Fifteenth Day of March, 1994

*Attest:*

Bruce Lehman

BRUCE LEHMAN

*Attesting Officer*

*Commissioner of Patents and Trademarks*